US006469445B1

(12) United States Patent
Nortrup et al.

(10) Patent No.: US 6,469,445 B1
(45) Date of Patent: Oct. 22, 2002

(54) HIGH CRI METAL HALIDE LAMP WITH CONSTANT COLOR THROUGHOUT LIFE

(75) Inventors: Edward H. Nortrup, Stoneham, MA (US); David M. Hrubowchak, Litchfield, NH (US); John A. Scholz, Georgetown, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/335,249

(22) Filed: Jun. 17, 1999

Related U.S. Application Data

(60) Provisional application No. 60/121,155, filed on Feb. 22, 1999.

(51) Int. Cl.[7] ..... H01J 17/20; H01J 61/18

(52) U.S. Cl. ..... 313/638; 313/639; 313/571; 313/637

(58) Field of Search ..... 313/638, 637, 313/639, 571

(56) References Cited

U.S. PATENT DOCUMENTS 5,057,743 A * 10/1991 Krasko et al. ..... 313/639
5,694,002 A * 12/1997 Krasko et al. ..... 313/641

* cited by examiner

*Primary Examiner*—Vip Patel
*Assistant Examiner*—Kevin Quarterman
(74) *Attorney, Agent, or Firm*—William H. McNeill

(57) ABSTRACT

A metal halide lamp with high color rendering index, greater then 80, with substantially constant color temperature through life. The lamp arc discharge vessel has a small volume, i.e., less than 1 cc, and contains iodides of sodium, scandium, lithium, dysprosium, and thallium along with mercury, a buffer gas and scandium metal. The addition of the scandium metal does not raise the arc discharge vessel temperature and significantly reduces the color temperature decline during life.

7 Claims, 2 Drawing Sheets

HIGH CRI METAL HALIDE LAMP WITH CONSTANT COLOR THROUGHOUT LIFE

This invention claims priority from Provisional Patent Application No. 60/121,155, filed Feb. 22, 1999.

FIELD OF THE INVENTION

This invention relates to high intensity discharge lamps and more particularly to metal halide lamps with high color rendering indexes (CRI).

BACKGROUND OF THE INVENTION

There are several metal halide lamp designs that yield color rendering indexes greater than 80 while maintaining a low color temperature of approximately 3100 K. One such design utilizes quartz as an arc discharge vessel material and includes iodides of sodium, scandium, lithium, dysprosium, and thallium within the chamber. The arc discharge vessel has a small volume, relative to conventional lamps, to provide enough arc discharge vessel wall temperature to sufficiently vaporize the additives and achieve the desired light output. This lamp design provides excellent light output properties; however, it does so only through a relatively short period of time. After approximately 2,000 hours of lamp operation the lamp color temperature decreases approximately 200 K and the lumen output also significantly decreases. Eventually, the lamp's photometric properties degrade to the point where the light output is no longer acceptable since the color temperature decrease continues at a rate of approximately 100 K per 1,000 hours.

This high CRI metal halide lamp produces significant line emission and the primary factor contributing to the decrease in color temperature through life is the loss of the scandium line emission. The scandium emission decreases at a faster rate than the other elemental emission and as a result blue radiation is preferentially lost and the resulting color temperature decreases. A secondary factor contributing to the decrease in color temperature is the changing color of the quartz wall. Wall reactions take place between the added chemistry and the quartz wall leading to quartz devitrification. The devitrified zone changes in color from clear to yellow. This area then absorbs shorter wavelength light resulting in a further decrease in the color temperature of the lamp. A tertiary factor contributing to decreased color temperature during lamp life is an increase in arc discharge vessel wall temperature caused by a loss in quartz transmission. Once the devitrified zone forms, it begins to discolor and absorb light causing a rise in the arc discharge vessel wall temperature. Arc discharge vessel wall blackening caused by tungsten transport from the electrode during lamp operation also significantly reduces the transmission through the quartz and increases the arc discharge vessel wall temperature. The arc discharge vessel wall temperature increase causes an increase in the melt vapor pressure. The sodium pressure, which provides more yellow and red radiation through spectral line broadening, increases the greatest. The increased sodium pressure causes the color temperature to decrease further.

Many sodium-scandium metal halide systems utilize a scandium metal chip within the arc discharge vessel chamber as a getter for impurities. By gettering initial and lifetime impurities the required starting voltage remains low and the free-iodine content of the chemistry also remains low. This creates a system that starts easily and has acceptable initial photometric performance. The addition of the chip has one large draw back in that it reacts with the wall and the iodides and creates a stain on the inner surface of the arc discharge vessel wall. This stain absorbs light and in turn creates a hot spot within the arc discharge vessel. The stain can increase the wall temperature by 100° C. This is not a concern in conventional metal halide lamps because the larger volume of the arc discharge vessel keeps the wall temperatures normally well below unacceptable wall temperatures. The conventional arc discharge vessels, which have volumes greater than 1 cc, operate at approximately 800° C., so the chip addition, with its concomitant stain, may cause the arc discharge vessel temperature to reach 900° C. This is an acceptable temperature for a long life lamp design having the larger arc vessel volume, considering the stain does disappear with time and the arc discharge vessel blackening becomes a more dominant factor in heating the arc discharge vessel.

Since the high CRI arc discharge vessel temperatures are approximately 940° C. without the addition of scandium metal to the system it was to be expected that the arc discharge vessel temperature would increase to over 1040° C. if scandium metal were used. Even if the stain disappeared during the early part of lamp life, the arc discharge vessel could not sustain these temperatures and the lamp life would be short caused by arc discharge vessel failure. The internal pressure of the arc discharge vessel during lamp operation is several atmospheres and this would cause the arc discharge vessel wall to bulge as the quartz viscosity decreased to a weakened state.

A second problem that was believed to be associated with the addition of scandium metal to the high CRI chemistry is that the metal halides are known to react with the chip during the initial aging of the lamp and thereby increase the scandium radiation. The increased scandium radiation would result in an unacceptably high color temperature because of the increased blue radiation. The color temperature would be increased to approximately 3500 K when the most desirable color is at 3100 K. Normally, this would be compensated for by reducing the amount of scandium iodide in the melt, however, in this particular chemistry, this would result in a very low scandium iodide amount in the arc discharge vessel and was believed that this would lead to even more dramatic color shifting when the scandium reacted with the wall during the life of the lamp. Another conventional method of reducing the initial color temperature is to increase the reflector coating height or thickness on the arc discharge vessel. Again, this technique would prove to be a problem because it would further increase the arc discharge vessel wall temperature and result in early arc discharge vessel failures.

To compensate for the lack of scandium metal in the small volume arc discharge lamp design, several clean processing steps were used to eliminate the contamination from the arc discharge vessel chamber during manufacture. These processes did reduce the initial contamination, reduce the starting voltage requirements, and produce a lamp with acceptable initial photometric performance, however, in spite of these improvements, the resulting lamp design still showed a steady color temperature decrease through the lamp life.

DISCLOSURE OF THE INVENTION

It is, therefore, an object of the invention to obviate the disadvantages of the prior art.

It is yet another object of the invention to provide a high CRI lamp with constant color through life.

These objects are accomplished, in one aspect of the invention, by the provision of an arc discharge lamp having a CRI>80 and a given color temperature which exhibits a variance of <3% over 2000 hours of operation, said lamp comprising: an arc discharge vessel of quartz having an electrode in each end, said vessel having a volume of about 0.25 to 0.8 cc, an iodide fill of 10 to 16 mg/cc, an amount of mercury in the range of 10 to 16 mg/cc, and an amount of scandium metal to maintain said given color temperature within said variance.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
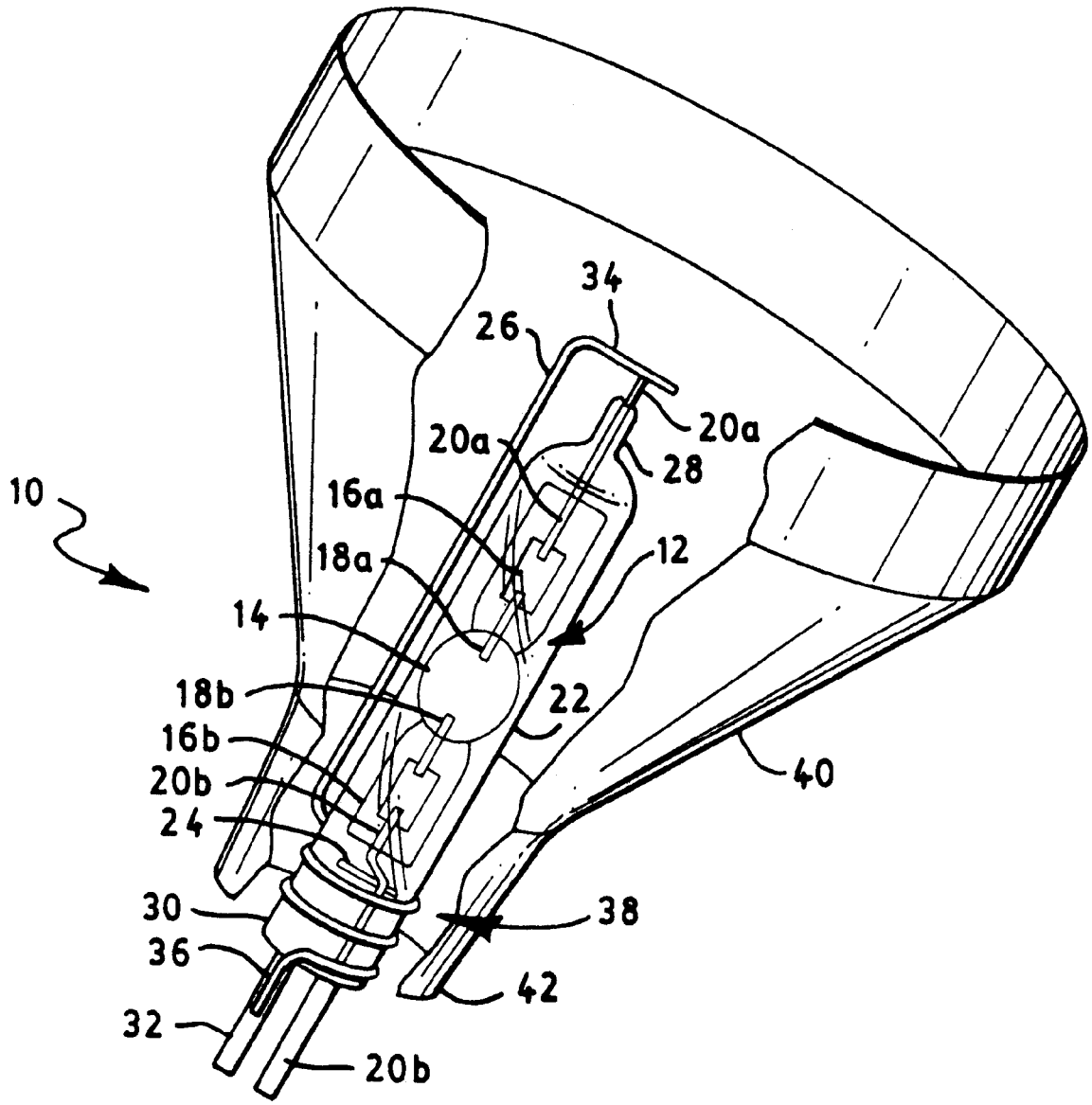
FIG. 1 illustrates a perspective, cut-away view of a reflector lamp employing the arc discharge vessel assembly of the invention.

Referring now to the drawings with greater particularity, there is shown in FIG. 1 a PAR lamp 10 utilizing an arc discharge vessel 12. The arc discharge vessel 12 has an arc discharge vessel cavity 14 that contains the arc discharge vessel chemistry, including a scandium metal chip. Two electrodes 18*a* and 18*b* protrude into cavity 14. The electrodes are electrically connected to moly foils 16*a* and 16*b* that are sealed into the arc discharge vessel 12. The moly foils are electrically connected to outer leads 20*a* and 20*b*. Outer lead 20*a* is electrically connected to frame support 26 after passing through seal 28. Outer lead 20*a* then passes through the outer bulb 40 and is connected to a power source. Outer lead 20*b* passes through seal 30, passes through outer bulb 40 and is connected to a power source.

Early in the development of the high CRI, small volume, metal halide lamp design a group of lamps accidentally was made with the addition of a scandium metal chip, as the arc discharge vessel temperature concerns were well known. This group of lamps exhibited the early photometric problem of high color temperature as a result of the reaction between the scandium metal and the added chemistry. The group of lamps was aged on a conventional system regardless of these problems and, surprisingly, the 5,000 hour photometric results showed only modest color shift through life and the group did not suffer from early lamp failures due to elevated arc discharge vessel wall temperatures. After observing these test results, several lamp tests were made to discover why the lamps performed so well. While the change in color temperature after 100 hours of operation is understood, the resulting reduction in color shift through life is not understood. The scandium chip fully reacts with the wall and with the fill chemistry within 100 hours and after this point the effects of the chip should be complete. The lamp life test results, however, unexpectedly show a different result in that the effect of the chip continues through life by reducing the color temperature shift.

As noted above, when a scandium chip was added to the arc discharge vessel the expectation from prior experience was to observe an arc discharge vessel temperature increase of approximately 100° C. as a result of the scandium stain. The actual result was much different than this prediction. The scandium chip never created the stain and the arc discharge vessel temperature did not appear to rise. Arc discharge vessels were observed through the first several thousand hours of operation and the stain never formed. This allowed the addition of the scandium chip without compromising the life of the lamp through early arc discharge vessel wall failure.

A second phenomenon observed was that the arc discharge vessel sodium to scandium ratio could be increased to correct the initial color temperature and the color temperature during life still remained stable. Although, in one of the preferred embodiments, where the $ScI_3$ amount was only 120 $\mu$g, the increased sodium to scandium ratio did not correct the initial color temperature. In this latter lamp design, however, the arc discharge vessel temperature was increased by approximately 10° C. by adding slightly more reflective coating on the arc discharge vessel. This temperature increase reduced the color temperature to 3100 K. The arc discharge vessel temperature was brought to approximately 950° C. with the increased coating. An accelerated test was performed between the new design and the original design without a scandium chip or increased coating. The results of the testing showed, again unexpectedly, that there was no increase in wall reaction with the new design. The groups were also aged on conventional systems for 1,000 hours and the photometric and electrical characteristics were observed. The test group with the scandium chip outperformed the control group with virtually no color decrease in the test group while the control group suffered a shift of approximately 80 K.

Figure 2:
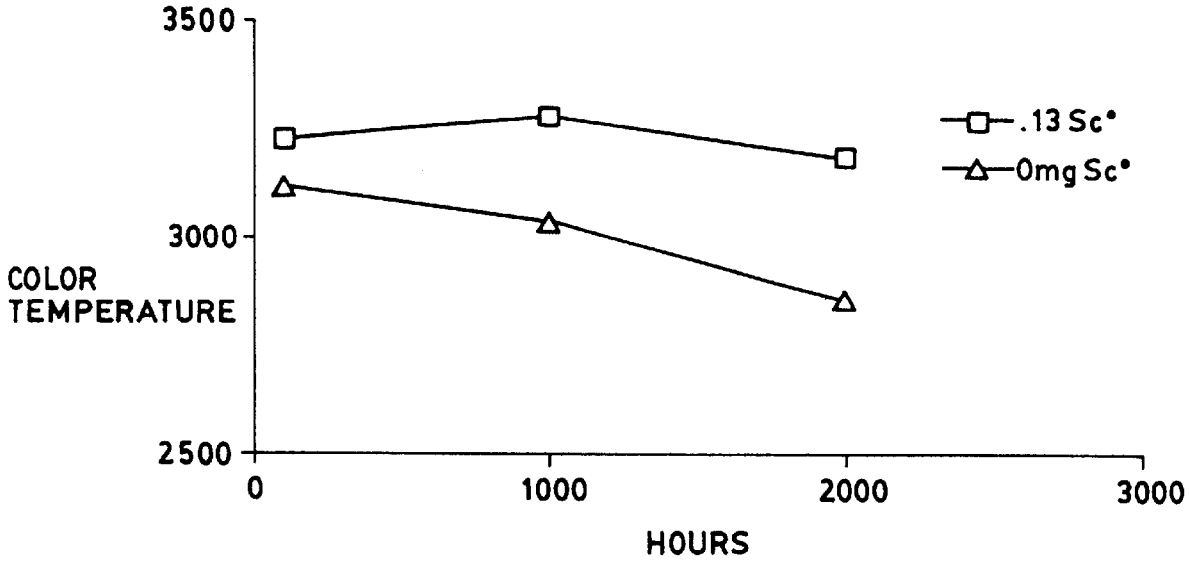
FIG. 2 illustrates the color temperature maintenance of the prior art lamp and the invention lamp.

The addition of the scandium chip to arc discharge vessels of small volume containing iodides of sodium, scandium, lithium, dysprosium, and thallium created a lamp that has excellent CRI, (greater than 80), and a color temperature of approximately 3100 K. And the color temperature does not significantly change during the life of the lamp. A graph of the color temperature of lamps with and without the scandium chip is provided in FIG. 2. As can be seen from FIG. 2, the lamps with the scandium chip show only a modest and easily tolerated change in color temperature over the 2,000 hours of operation, approximately 40 K, while the similar lamps without the scandium chip show an unacceptable shift of approximately 260 K.

Three examples of the preferred embodiment are provided for a better understanding of the invention. These examples do not represent all of the possible embodiments of the invention; however, they are given to provide a better understanding of the invention. The chemistry ratios can also be easily modified to provide color temperatures other than 3100 K.

The first example is a 70 watt PAR30 lamp where the arc discharge vessel has an internal volume of approximately 0.25 cc. Approximately 4 mg of a $NaI:ScI_3:LiI:TlI:DyI_3$ mixture is added to the arc discharge vessel chamber along with approximately 4 mg of Hg and approximately 0.065 to 0.13 mg of scandium metal. The mixture has approximate weight ratios of 53.0:3.2:16.8:4.1:22.9. The arc discharge vessel is back filled with approximately 150 torr of argon or xenon. The ends of the arc discharge vessel are coated with approximately 3.5 mm of $ZrO_2$. The arc discharge vessel is hermetically sealed in a glass jacket that is back filled with approximately 400 torr of nitrogen or other suitable gas. This jacketed assembly is then sealed into a PAR30 outer jacket assembly to form a finished lamp. This lamp had a color temperature of 3093 K and a color variance of 2.8% over 2,000 hours of operation.

The second example is a 70 watt ED17 lamp where the arc discharge vessel has an internal volume of approximately 0.50 cc. Approximately 8 mg of a $NaI:ScI_3:LiI:TlI:DyI_3$ mixture is added to the arc discharge vessel chamber along with approximately 5 mg of Hg and approximately 0.065 to 0.13 mg of scandium metal. The mixture has approximate weight ratios of 54.6:1.6:16.8:4.1:22.9. The arc discharge vessel is back filled with approximately 150 torr of argon or xenon. The ends of the arc discharge vessel are coated with approximately 3.5 mm of $ZrO_2$. The arc discharge vessel is hermetically sealed in a glass outer jacket assembly that is evacuated to form a finished lamp. This lamp had a color temperature of 2924 K and a color variance of 2.0% over 2,000 hours of operation.

The third example is a 100 watt ED17 lamp where the arc discharge vessel has an internal volume of approximately 0.80 cc. Approximately 8 mg of a $NaI:ScI_3:LiI:TlI:DyI_3$ mixture is added to the arc discharge vessel chamber along with approximately 8 mg of Hg and 0.13 mg of scandium metal. The mixture has approximate weight ratios of 54.6:1.6:16.8:4.1:22.9. The arc discharge vessel is back filled with approximately 150 torr of argon or xenon. The ends of the arc discharge vessel are coated with approximately 4.0 mm of $ZrO_2$. The arc discharge vessel is hermetically sealed in a glass outer jacket assembly that is evacuated to form a finished lamp. This lamp had a color temperature of 3130 K and a color variance of 2.7% over 2,000 hours of operation.

Thus, it will be seen that the addition of a scandium chip in a situation where its use was contra-indicated, has provided superior benefits to high CRI metal halide lamps.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc discharge lamp having a CRI>80 and a given color temperature which exhibits a variance of <3% over 2000 hours of operation, said lamp comprising: an arc discharge vessel of quartz having an electrode in each end, said vessel having a volume of about 0.25 to 0.8 cc, an iodide fill of 10 to 16 mg/cc, an amount of mercury in the range of 10 to 16 mg/cc, and an amount of scandium metal to maintain said given color temperature within said variance.

2. The arc discharge vessel lamp of claim 1 wherein said iodides include sodium, scandium, lithium dysprosium and thallium.

3. The arc discharge lamp of claim 1 wherein the amount of iodides and the amount of mercury are equal.

4. The arc discharge lamp of claim 2 wherein said iodides are present in a weight ratio of 53.0:3.2; 16.8:4.1:22.9.

5. The arc discharge lamp of claim 2 wherein said iodides are present in a weight ratio of 54.6:1.6:16.8:4.1:22.9.

6. The arc discharge lamp of claim 1 or 2 or 3 or 4 or 5 wherein said scandium metal is present in an amount of 0.065 to 0.13 mg.

7. The arc discharge lamp of claim 6 wherein said amount of scandium metal is about 0.13 mg.

* * * * *